United States Patent [19]

Hacetoglu et al.

[11] Patent Number: 4,528,031

[45] Date of Patent: Jul. 9, 1985

[54] FLOW PROMOTOR FOR PARTICULATE MATERIAL

[75] Inventors: Ararat Hacetoglu, St. Catharines; William K. Kodatsky, Welland, both of Canada

[73] Assignee: Cyanamid Canada, Inc., Ontario, Canada

[21] Appl. No.: 621,009

[22] Filed: Jun. 15, 1984

[51] Int. Cl.[3] ..... C21C 7/00

[52] U.S. Cl. ..... 75/53; 75/58

[58] Field of Search ..... 75/53, 58; 148/23–26

[56] References Cited

U.S. PATENT DOCUMENTS

| | | | |
|---|---|---|---|
| 2,863,755 | 12/1958 | Kurzinski | 75/58 |
| 3,957,502 | 5/1976 | Cull | 75/58 |
| 4,019,897 | 4/1977 | Yoshida | 75/58 |

*Primary Examiner*—Peter D. Rosenberg

*Attorney, Agent, or Firm*—Frank M. Van Riet

[57] ABSTRACT

There is disclosed a novel method for enhancing the flow of particulate material, particularly carbide-based desulfurizing agents (DSR's) used for the removal of sulfur from hot metal. A novel composition is also taught in which the DSR is in admixture with an organic, polar liquid flow promoter. The novel composition has improved flow characteristics or flowability and reduces the possibility of clogging in conduits and lances.

10 Claims, No Drawings

FLOW PROMOTOR FOR PARTICULATE MATERIAL

The present invention relates to a composition having, and method for, improving the flow characteristics or flowability of particulate materials using organic, polar liquids as flow promoter and in particular relates to the addition of flow promoters to particulate materials used in the desulfurization of hot metal (molten iron alloy).

The addition of various compounds such as cab-o-sil (trademark), stearates, silicones and carbon compounds to fine particulate material in an attempt to make them more free flowing is known.

In the more specific field of hot metal desulfurization using particulate desulfurizing reagent (DSR), a good flowing DSR is required for easy pneumatic transportation and a smooth injection, the DSR being injected into the hot metal by means of a lance submersed in the hot metal. Commonly used DSR'S include calcium carbide or lime which have the disadvantage that clogging occurs in the lance and/or dispenser orifice due to lumping of the DSR as a result of its relatively poor flow characteristics. Also, upon addition of the DSR to the molten metal, dynamic flow within the reaction vessel is interrupted and annoying splash occurs due to pulsations in the feedline resultant from poor flowing DSR.

Furthermore, in order to improve mixing of the DSR in the molten iron alloy, a gas-releasing agent frequently has to be added to the DSR. Thus, upon mixing within the molten metal, gas is released thereby dispersing the DSR particles to give improved chemical efficiency, the increased surface area of the separated particles permitting calcium to react more freely with undesired sulfur in the molten metal.

It is also known to attempt to improve the flowability of DSR (while also effectively including a reducing agent), to add a solid carbon source to the DSR. This causes considerable undesirable abrasive wear on transport equipment.

There is therefore a specific need for a means by which the flow characteristics or flowability of a DSR can be improved in order to avoid the aforementioned disadvantages of known techniques. The present invention is directed to improving the flow characteristics of particulate, fine materials by the addition of organic, polar liquids in order to permit, in the specific field of hot metal treatment, smoother injection and better controlled injection rates into the hot metal. The improved flowability of the DSR also permits a more constant final end point sulfur content in the hot metal so that a reduced reagent usage is obtained.

Thus, according to the present invention there is provided a composition having improved flow characteristics which comprises a particulate carbide-based desulfurizing reagent in admixture with an organic, polar liquid which promotes flow of, and is inert with respect to, the desulfurizing reagent.

By the term flow characteristics or flowability of a particulate DSR mass is intended the relative ease with which that mass will move or change its settled position, such as when the orientation of a container holding the mass is changed. A mass with poor flow characteristics shears in agglomerated lumps of various sizes, while a mass with good flowability moves as individual particles in a manner closely resembling that of a liquid.

A desulfurizing reagent (DSR) is any material which, when added to hot metal (molten iron alloy) reduces the sulfur content thereof. Such materials include diamide lime, calcium oxide, calcium carbonate, calcium fluoride and various carbon forms.

Thus, a calcium carbide-based desulfurizing reagent is a DSR in which the principal constituent is calcium carbide, preferably furnace calcium carbide, and optionally also includes, as lesser constituents, diamide lime, carbon, calcium carbonate, calcium fluoride and/or other materials used in treating hot metal (molten iron alloys).

While calcium carbide can be used from any source, furnace calcium carbide is generally used in desulfurizing processes for treating hot metal. Furnace calcium carbide is commercial carbide which is 70–85% by weight $CaC_2$, produced in an electric furnace.

As a desulfurizing reagent, it is known to use furnace calcium carbide together with diamide lime, the latter being obtained as a by-product in the manufacture of hydrogen cyanamide. Thus, nitrogenation of calcium carbide to produce calcium cyanamide results in the liberation of carbon, thus:

$$CaC_2 + N_2 \xrightarrow{1100^\circ C.} CaNCN + C$$

Further reaction of the calcium cyanamide with carbon dioxide in aqueous solution to produce hydrogen cyanamide results in the coprecipitation of the calcium carbonate and carbon, thus:

$$CaNCN + C + CO_2 \xrightarrow{H_2O} CaCO_3{:}\ C \downarrow + H_2NCN$$

Filtration and drying of the precipitated diamide lime results in a product consisting of 85% calcium carbonate and 11% carbon, usually in graphitic form. The diamide lime, when added to calcium carbide, used as a DSR, acts as a gas releasing material and aids in the calcium carbide separating and mixing in hot metal upon injection thereto. Thus, the DSR is able to react more efficiently with sulfur in the hot metal. The CaD desulfurizing reagent ($CaC_2$ and diamide lime) is usually a milled mixture of furnace calcium carbide and diamide lime. When the furnace $CaC_2$ has an 80% by weight $CaC_2$ content then a 60:40 CaD reagent mix contains 48% $CaC_2$. A preferred embodiment of the present invention uses a 60:40 CaD mix as the particulate carbide-based DSR.

In another aspect of the present invention there is provided a method of improving the flow characteristics of a particular carbide-based desulfurizing reagent which comprising admixing therewith an organic, polar liquid which promotes flow of, and is substantially inert with respect to, the desulfurizing reagent.

The organic, polar liquid which is used as a flow promoter can be any compound with up to 10 carbon atoms which is preferably an alcohol, ester, ketone, ether, aldehyde or halogenated alkane. Specific suitable flow promoters include aliphatic alcohols such as methanol, ethanol, n- and i-propyl alcohol, n-, i- and t-butyl alcohol, n-, i- and t-allyl alcohol, n-octanol, 2-ethylhexyl alcohol and ethylene glycol; aromatic alcohols such as benzyl alcohol, 2-phenethyl alcohol; hydroxyalkylamines such as 3 bis(hydroxyethyl)propylamine;

heterocylic alcohols such as furfuryl alcohol and tetrahydrofuryl alcohol; ketones such as acetone, ethyl methyl ketone, di-n-propyl ketone, di-n-butyl ketone and di-i-butyl ketone; esters such as methyl acetate, propyl acetate, amyl acetate, benzyl acetate, methyl propionate and propyl propionate; ethers such as di-n- and iso-propyl ether, di-n-butylether, di-amylether, propyl butyl ether and di-benzylether; aldehydes such as acetaldehyde; and halogenated alkanes such as ethyl chloride.

However, the alcohols, ethers and ketones are preferred and in particular methanol, isopropyl alcohol, di-n-butylether and acetone.

It is preferred that the organic, polar liquid is added to the particulate material in an amount of about 0.01 to about 1% by weight and in particular in amount of 0.02 to 0.5% by weight. Optimum results have been obtained with isopropyl alcohol at the lower end of the range while similar results have been obtained with methanol using 2.5 times the amount of flow promoter with a 60:40 CaD reagent mix.

It is preferred that at least 50% of the particles under treatment have a size less than about 100 microns, i.e. will pass through 150 Tyler mesh. While the flow promoter can effectively be used with any DSR, addition to CaD or regular furnace grade calcium carbide is particularly effective.

The flow promoter may be added to the calcium carbide-based material by spraying in a post-grinding operation.

Particular embodiments of the present invention will now be given, by way of non-limiting example only.

EXAMPLES 1 AND 2

25 drops of acetone and 25 drops of methanol were added to separate samples of 350 grams of 60:40 CaD. The samples were shaken and their appearance in a glass jar was noted. Both samples had excellent flowing characteristics with little agglomeration of particles. The amount of flow promoter added to the 60:40 CaD was calculated to be approximately 0.1% by weight.

While the angle of repose of a pile of DSR is a useful measure of flowability, successful relative judgments can be made on a numerical scale of 0 to 5 where 0 indicates liquid-type flow characteristics and 5 indicates flow only as a caked mass or agglomerates of particles. The following Examples 3 to 9 utilized this index of flowability.

EXAMPLES 3 TO 9

Samples of 60:40 CaD were treated in a similar manner to the previous Examples 1 and 2. In the table below, Example 3 is a standard and Example 4 indicates no improvement within the margin of experimental error when hexane is used as the additive.

TABLE

Samples of DSR material were weighed out and the addition of a chemical was made to each. These samples were then tested for flow and screened for +150 mesh, −150 - and −45 μm.

| Example No. | Sample | % +150 | % −150 +45 μm (+ 45 μm) | % −45 μm | Index of Flowability |
|---|---|---|---|---|---|
| 3 | DSR 60:40 | 11% | 87.4% (small balls) | 1.6% | 3.2 |
| 4 | DSR 60:40 + Hexane | 10.6% | 88.8% (small balls) | .6% | 3.0 |
| 5 | DSR 60:40 + Butyl Ether | 11.3% | 78.9% (very small balls) | 9.8% | 1.8 |
| 6 | DSR 60:40 + Butyl Acetate | 11.2% | 82.5% (very small balls) | 6.3% | 2.4 |
| 7 | DSR 60:40 + Methanol | 11.0% | 73.5% (no balls) | 15.5% | 0.6 |
| 8 | DSR 60:40 + Isopropyl Alcohol | 8.0% | 57.3% (no balls) | 34.7% | 1.1 |
| 9 | DSR 60:40 + Butanol | 9.4% | 24.7% (no balls) | 65.9% | 0.9 |

The addition of the ether, ester and alcohols improved flow characteristics of the DSR. The improvements were noticeably greater with the addition of methanol, butanol and isopropyl alcohol. The hexane did not change the flowability of the DSR to any noticeable extent.

It was also found that methanol and isopropyl alcohol gave the best results with additions in the range of about 0.08 to 0.02% by weight for 60:40 CaD whereas the requirements for DSR 100 (which is 100% ground furnace carbide) were about 0.04 to about 0.1% by weight. Optimum results were in fact obtained with isopropyl alcohol at the lower end of the range.

While not being restricted to any specific theory, it is believed that the mechanism by which the flow promoter improves the flowability of the particulate material is as follows. Most particulate material retains a static charge resultant from its method of production by grinding. Addition of the liquid polar flow promoter to the statically charged particulate material effectively neutralizes and separates the particulate material thus preventing agglomeration.

While the present invention has been described with particular reference to a D.S.R. used for treating hot metal, it will be appreciated that the invention can equally well be applied to any particulate material in any situation where improvement in the flow characteristics of the material is desired.

The embodiments of the invention in which an exclusive property or privilege is claimed are defined as follows:

1. A composition having improved flow characteristics which comprises a particulate carbide-based desulfurizing reagent in admixture with an organic, polar liquid which promotes flow of, and is inert with respect to, the desulfurizing reagent.

2. The composition of claim 1 wherein the desulfurizing reagent is an alkaline-earth carbide-based desulfurizing reagent.

3. The composition of claim 1 wherein the desulfurizing reagent comprises furnace calcium carbide.

4. The composition of claim 3 wherein the desulfurizing reagent further comprises at least one material selected from the group consisting of diamide lime, carbon, calcium carbonate, calcium oxide, and calcium fluoride.

5. The composition of claim 1, 3 or 4 wherein the organic, polar liquid is a compound with up to ten carbon atoms selected from the group consisting of alcohols, esters, ketones, ethers, aldehydes and halogenated alkanes.

6. The composition of claim 1, 3 or 4 wherein the organic, polar liquid is a compound with up to ten carbon atoms selected from the group consisting of ethers, alcohols and ketones.

7. The composition of claim 1, 3 or 4 wherein the polar liquid is selected from the group consisting of di-n-butyl ether, isopropyl alcohol, methanol and acetone.

8. The composition of claim 1 wherein the organic, polar liquid is present is an amount of 0.01% to 1.0% by weight.

9. A composition having improved flow characteristics which comprises furnace calcium carbide having 0–50% calcium carbonate, 0–50% diamide lime, 0–15% carbon and 0–5% fluorspar, said carbide being in admixture with an organic, polar liquid selected from the group consisting of di-n-butyl ether, isopropyl alcohol, methanol and acetone.

10. A method of improving the flow characteristics of a particulate carbide-based desulfurizing reagent which comprises admixing therewith an organic, polar liquid which promotes flow of, and is inert with respect to, the desulfurizing reagent.

* * * * *